US005799498A

United States Patent [19]

Park

[11] Patent Number: 5,799,498

[45] Date of Patent: Sep. 1, 1998

[54] DEFROSTER FOR INDIRECT-FREEZING REFRIGERATOR

[75] Inventor: Jun Bae Park, Changwan-shi, Rep. of Korea

[73] Assignee: Electronics Inc., Rep. of Korea

[21] Appl. No.: 528,418

[22] Filed: Sep. 14, 1995

[30] Foreign Application Priority Data

Sep. 15, 1994 [KR] Rep. of Korea ..... 1994-23419

[51] Int. Cl.[6] ..... F25D 21/02

[52] U.S. Cl. ..... 62/154; 62/140

[58] Field of Search ..... 62/140, 151, 154, 62/80, 128; 165/17; 340/607

[56] References Cited

U.S. PATENT DOCUMENTS 4,123,792 10/1978 Gephart et al. ..... 62/154 X 4,316,365 2/1982 Mueller et al. ..... 62/140 X 4,724,678 2/1988 Pohl ..... 62/154 X

*Primary Examiner*—Harry B. Tanner

*Attorney, Agent, or Firm*—Spencer & Frank

[57] ABSTRACT

A defroster for an indirect-freezing refrigerator is disclosed including a fan motor for circulating freezing air; a light passing hole for engagingly rotating with the rotation axis of the fan motor; a photointerrupt light emitting portion for emitting light toward the light passing hole of the rotation means; a photointerrupt light receiving portion for outputting a corresponding period, whether the emitted light passes through the hole or not; a defrosting heater for removing frost formed; and a microcomputer for receiving a signal varying with the variation of rotation number from the rotation number measuring means, thereby controlling the defrosting heater.

2 Claims, 6 Drawing Sheets

DEFROSTER FOR INDIRECT-FREEZING REFRIGERATOR

FIELD OF THE INVENTION

The present invention relates to a defroster for an indirect-freezing refrigerator, and more particularly, to a defroster for performing optimal defrosting by measuring the rotation number of a fan motor varying with the amount of frost produced when a compressor operates.

BACKGROUND OF THE INVENTION

Referring to FIG. 1, a defroster of a conventional indirect-freezing refrigerator comprises a temperature controller 1 for switching a compressor 5 according to temperature, compressor 5 for compressing a coolant for freezing, a defrosting timer 2 for accumulating the operation time of compressor 5 to determine a defrosting time and to convert a mode into a defrosting mode, an overload protecting portion 2*a* for preventing overload, a defrosting heater 4, a defrosting controller 3 for controlling the end of defrosting after defrosting operation, and a power plug 6 for supplying power.

As shown in FIG. 2, along the path of freezing air of the refrigerator, there are provided compressor 5 for freezing, fan motor 7 for circulating freezing air of freezing chamber 16 and cooling chamber 17, and evaporator 8 for exchanging heat.

According to the operation of the conventional technology, when defrosting timer 2 is coupled to the fourth contact after receiving power from power plug 6, an electric line is formed to operate compressor 5. At the same time, defrosting timer 2 for accumulating the operation time of compressor 5 to determine a defrosting time and to convert a mode into a defrosting mode operates. In a state in which the set time of defrosting timer 2 does not pass, when temperature controller 1 does not reach an appropriate temperature, the compressor continues to operate. When temperature controller 1 reaches an appropriate temperature, the contact is detached to stop the operation of compressor 5. Only when the compressor operates, the defrosting timer counts time.

During the operation of compressor 5, when the set time of defrosting timer 2 is finished, defrosting timer 2 is switched to the second contact, and compressor 5 stops. Here, if the temperature detected by defrosting controller 3 is below an appropriate temperature, the contact of defrosting controller 3 is electrically coupled to operate defrosting heater 4.

Conversely, if the temperature detected by defrosting controller 3 is above an appropriate temperature, defrosting timer 2 is switched to the fourth contact to repeat the above operation.

The freezing air path through which the freezing air of the refrigerator is circulated is formed by producing heat exchange by evaporator 8 when compressor 5 operates, and then circulating the freezing air by fan motor 7, as shown in FIG. 2.

For the determination of defrosting period in the conventional technology, when a predetermined accumulation time set by defrosting timer 2 is finished, defrosting is performed. This operates regardless of frost formed on the evaporator.

By doing so, a large quantity of frost produced on evaporator 8 via the freezing air path of the refrigerator shown in FIG. 2 interrupts the freezing air path, deteriorating a freezing performance. Here, defrosting is directly connected with the extension of the defrosting time, affecting the temperature rise in the refrigerator. This deteriorates the freezing performance of the refrigerator.

SUMMARY OF THE INVENTION

Therefore, it is an object of the present invention to provide a defroster for an indirect-freezing refrigerator in which freezing loss due to defrosting performed by predetermined periods regardless of the amount of frost produced when a compressor operates is prevented, the amount of frost is measured by the variation of rotation number of a fan motor produced due to the load of the fan motor, a defrosting heater is driven according to the measured amount of frost, thereby performing optimal defrosting and therefore enhancing the performance of products.

To accomplish the object of the present invention, there is provided a defroster for an indirect-freezing refrigerator comprising: a fan motor for circulating freezing air; rotation number measuring means for measuring the rotation number of the fan motor; a defrosting heater for removing frost formed; and a microcomputer for receiving a signal varying with the variation of rotation number from the rotation number measuring means, thereby controlling the defrosting heater.

BRIEF DESCRIPTION OF THE ATTACHED DRAWINGS

DETAILED DESCRIPTION OF THE INVENTION

Figure 1:
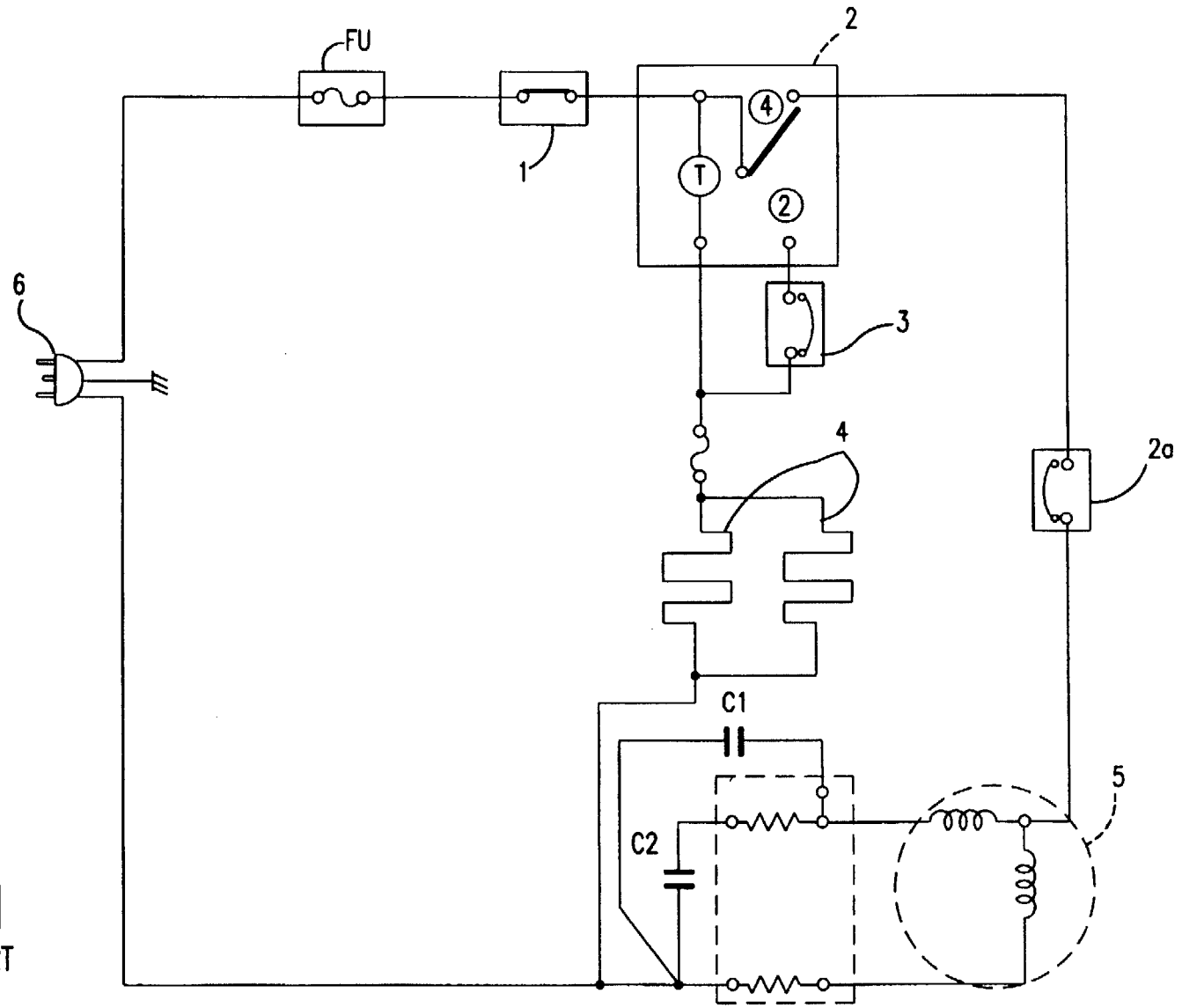
FIG. 1 PRIOR ART
FIG. 1 is a circuit diagram of a conventional defroster for a refrigerator.

Referring to FIGS. 3A, 3B, 4 and 5, the defroster of an indirect-freezing refrigerator of the present invention comprises a rotation disk 11 installed at the center of a shaft 13 of fan motor 7, a light passing circular hole 14 for transmitting light incident on rotation disk 11, a photointerrupt light emitting portion 9*a* for emitting light to light passing circular hole 14 of rotation disk 11, a photointerrupt light receiving portion 9*b* for detecting light passing through light passing circular hole 14 from photointerrupt light emitting portion 9*a*, a photointerrupt support member 12 for fixing and supporting photointerrupt light emitting portion 9*a* and light receiving portion 9*b* onto both upper sides of rotation disk 11, and a microcomputer for controlling fan motor 7 and defrosting heater 4 after receiving a signal detected by photointerrupt light receiving portion 9*b*.

When rotation disk 11 installed at the center of shaft 13, that is, the rotation axis of fan motor 7, rotates, photointerrupt light emitting portion 9*a* continues to emit light. When rotation disk 11 rotates and light passing circular hole 14 reaches the center of photointerrupt light emitting portion 9*a* and light receiving portion 9*b*, light is detected by photointerrupt light receiving portion 9*b*, which detects the absence or presence of light passing. The detection signal is input to port2 (P2) of microcomputer 15. The microcomputer measures the rotation number of fan motor 7.

Figure 4:
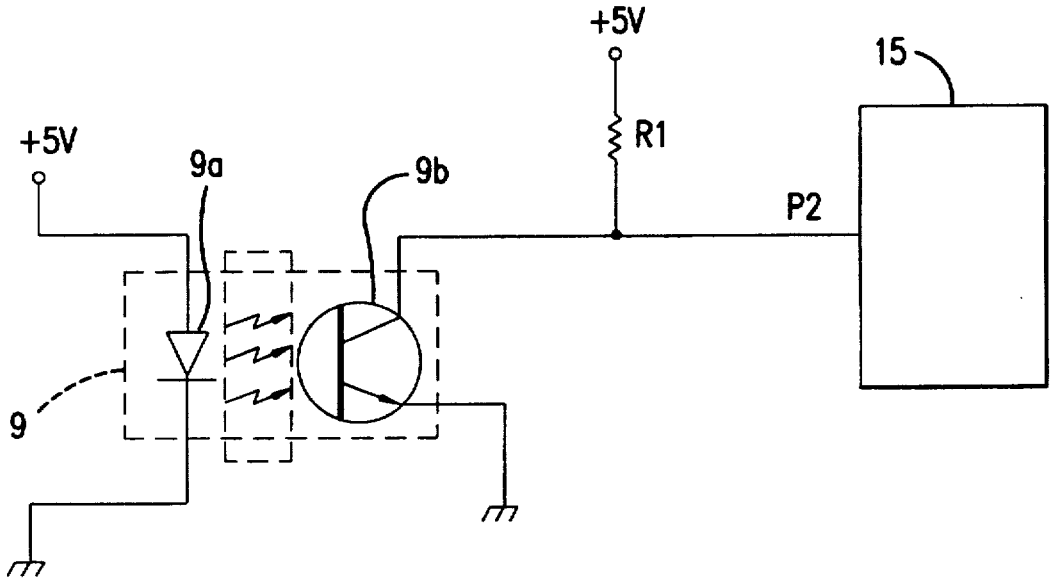
FIG. 4 is a circuit diagram of measuring the rotation speed of the fan motor according to the present invention.

As shown in FIG. 4, while light is emitted from light emitting portion 9*a* and not detected by light receiving portion 9*b*, an electrical signal of 0 V is input to port2 (P2) of microcomputer 15. While light receiving portion 9*b* detects light, 5 V is input to port2 (P2). One period of 0 V and 5 V detected by microcomputer 15 corresponds to one revolution of fan motor 7. The time of one period is measured by microcomputer 15, deciding a defrosting time.

Figure 5:
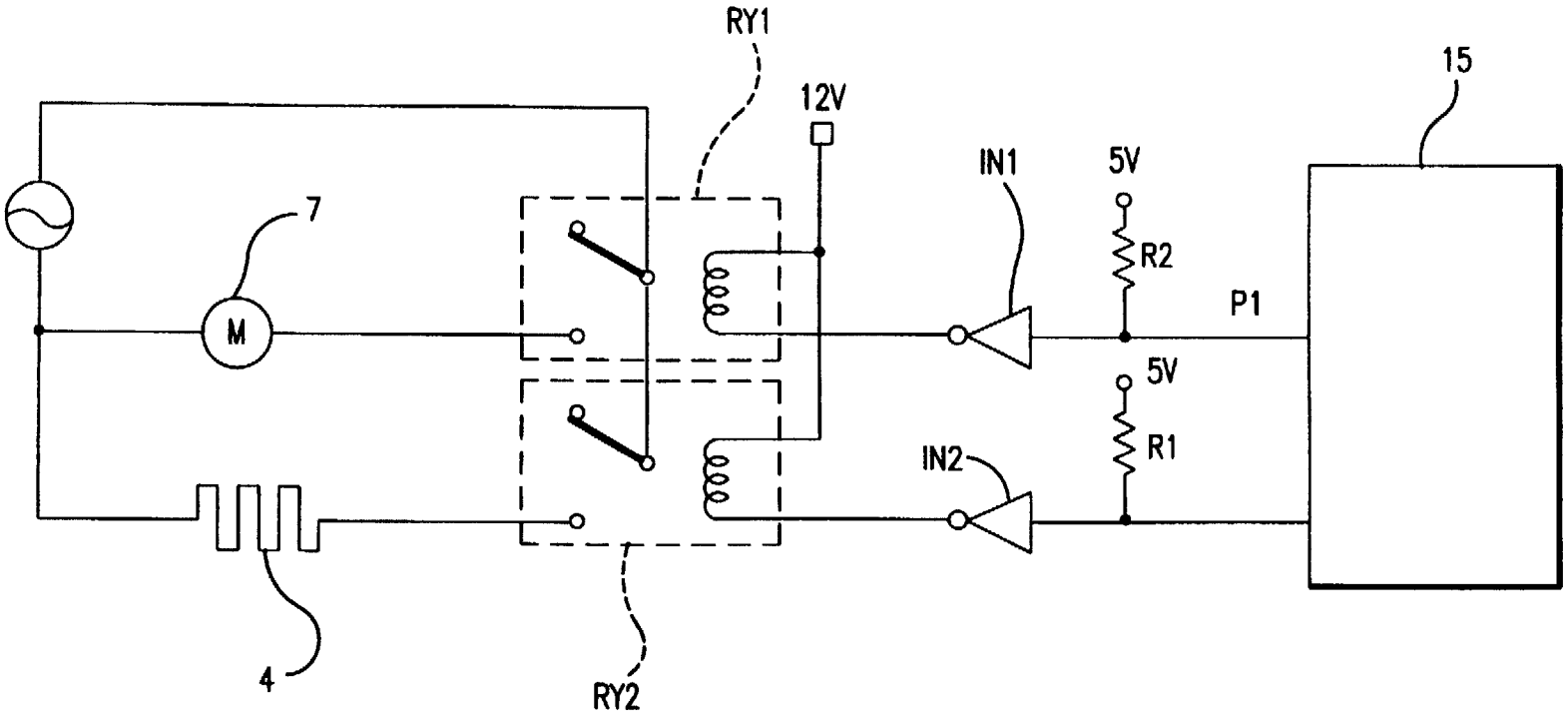
FIG. 5 is a circuit diagram of the output of the fan motor and defrosting heater of the present invention.

Corresponding to the period and time detected by microcomputer 15, the output signals of port1 (P1) and port2 (P12) of microcomputer 15 of FIG. 5 are inverted by inverters IN1 and IN2. Fan motor 7 and defrosting heater 4 are controlled by the contact of relays RY1 and RY2.

Figure 6:
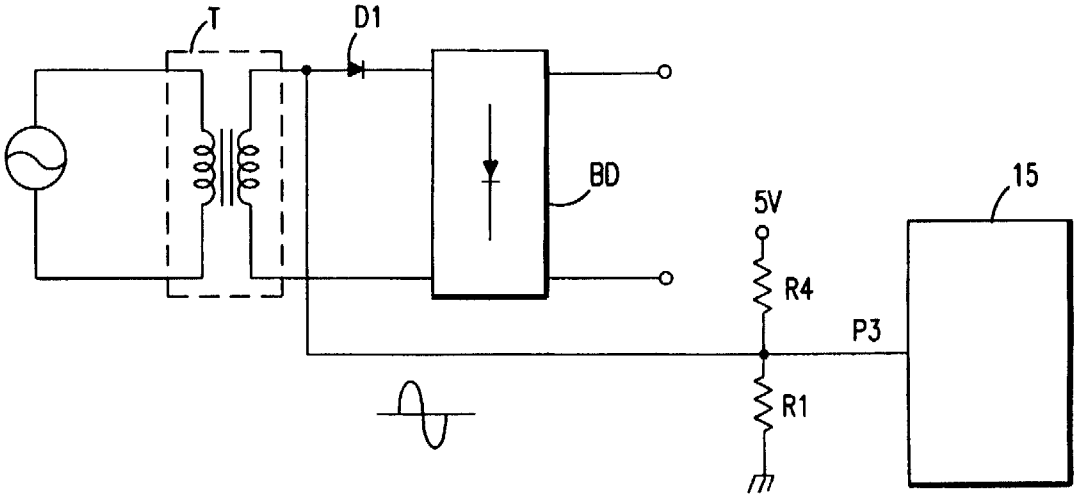
FIG. 6 is a circuit diagram of detecting a power voltage of the present invention.

In order to prevent the variation of rotation number of fan motor 7 according to the variation of power voltage, as shown in FIG. 6, the variation of rotation number produced besides the rated voltage of fan motor 7 is proportionally compensated for by a power voltage detector having a transformer T, diode D1, bridge diode BD, resistors R4 and R5, and microcomputer 15. This obtains a precise rotation number of fan motor 7.

Figure 2:
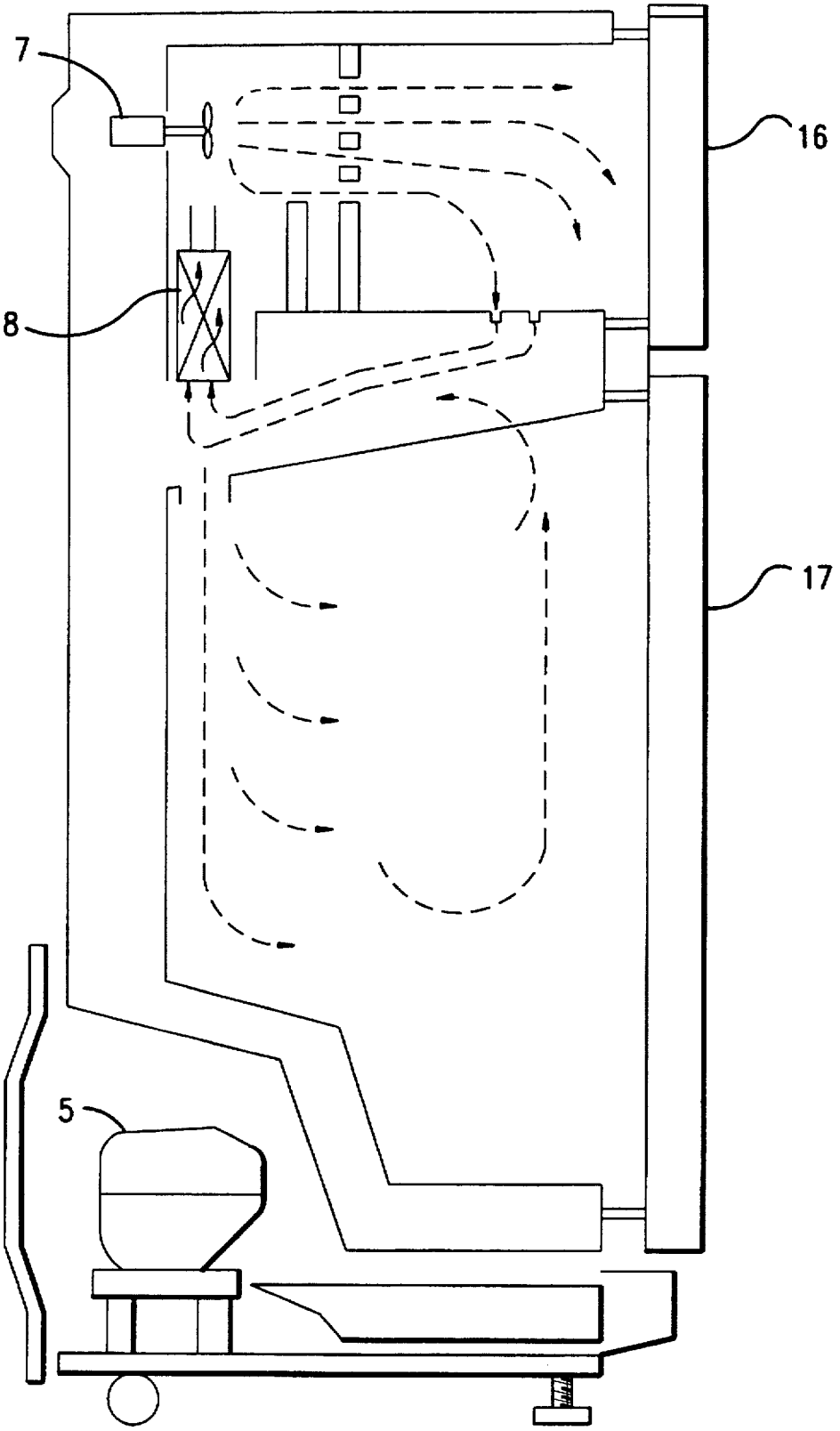
FIG.2 PRIOR ART
FIG. 2 illustrates a freezing air path of the conventional refrigerator.
Figure 3A:
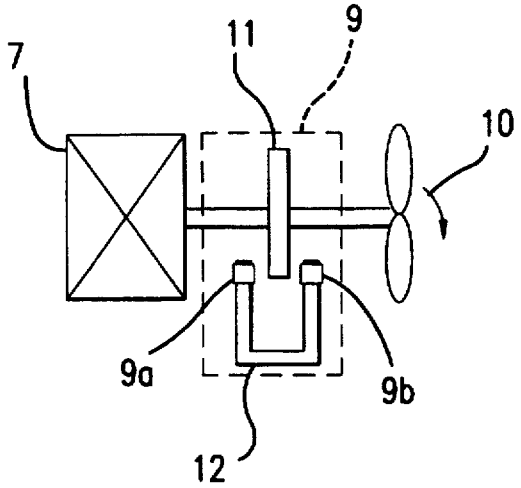
FIGS. 3A and 3B shows a means of measuring the rotation number for detecting the rotation speed of the fan motor of the present invention, FIG. 3A showing a state in which the rotation number measuring means is attached to the fan motor and FIG. 3B showing the perspective view of the rotation number measuring means based upon FIG. 3A.
Figure 3B:
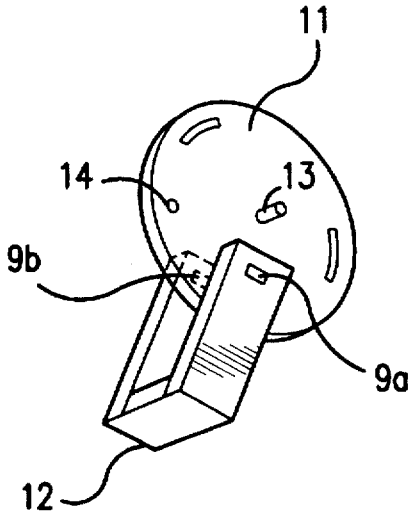

As shown in FIG. 2, while freezing air is circulated, a large quantity of frost is formed on evaporator 8. The frost acts to interrupt the flow of freezing air, reducing the rotation number of fan motor 7 due to overload. The amount of frost is measured by the variation of rotation number.

The variation of rotation number of fan motor 7 due to the variation of the external voltage is compensated for using the power voltage detector of FIG. 6. The operation time of the defroster of the refrigerator is determined by the variation of rotation number of the fan motor due to the amount of frost.

Figure 7:
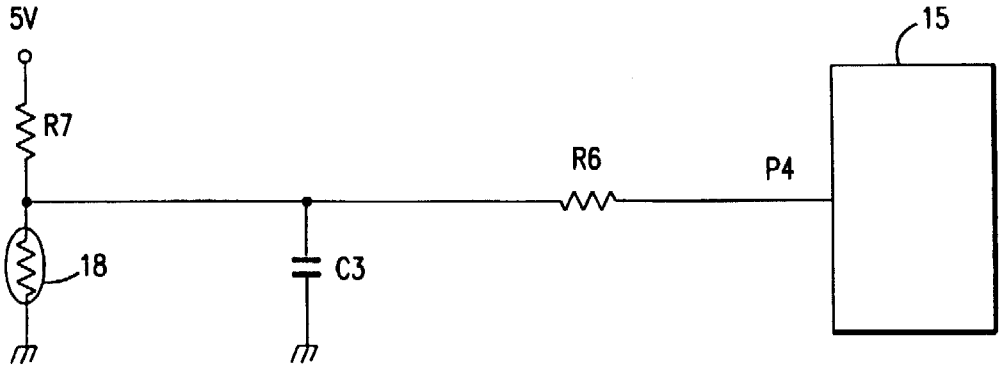
FIG. 7 is a circuit diagram of detecting a defrosting temperature of the present invention.

Returning after the defrosting operation is performed by the defrosting temperature detector of FIG. 7 formed by connecting defrosting sensor 18, resistors R6 and R7 and condenser C3 to port4 (P4) of microcomputer 15, when the temperature of the refrigerator is above an appropriate temperature.

Figure 8:
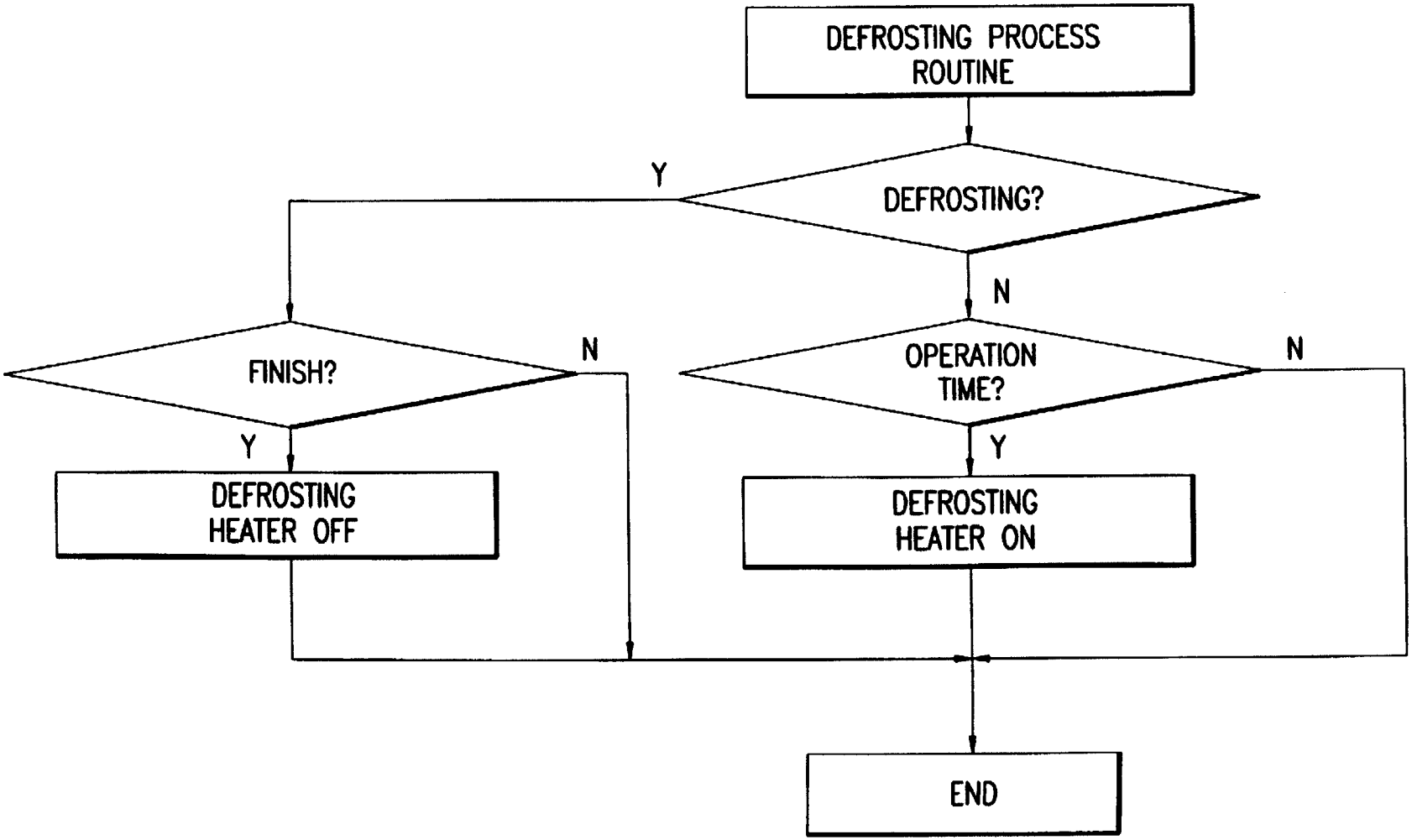
FIG. 8 is a flowchart of a defrosting process of the present invention.

Referring to FIG. 8, it is determined whether the refrigerator performs defrosting or not. If so, it is determined whether temperature is raised or not after defrosting heater 4 emits heat. If defrosting is finished, defrosting heater is turned off. If defrosting is not performed in the refrigerator, it is determined whether frost is formed in a large quantity, in other words, the current time is the defrosting operation time or not due to the reduction of rotation number of fan motor 7 below an appropriate number. In case of the defrosting operation time, defrosting heater 4 is turned on.

As described above, the amount of frost formed on the evaporator is detected according to the variation of rotation number and the optimal defrosting is performed at an appropriate time, reducing freezing loss and the temperature variation within the refrigerator.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A defroster for an indirect-freezing refrigerator comprising:

a fan motor for circulating freezing air;

rotation number measuring means for measuring the rotation number of said fan motor;

a defrosting heater for removing frost formed; and a microcomputer for receiving a signal varying with the variation of rotation number from said rotation number measuring means, thereby controlling said defrosting heater.

2. A defroster for an indirect-freezing refrigerator as claimed in claim 1, wherein said rotation number measuring means comprises:

rotation means for engagingly rotating with the rotation axis of said fan motor, said measuring means having a light passing hole;

a photointerrupt light emitting portion for emitting light toward said light passing hole of said rotation means; and a photointerrupt light receiving portion for outputting a corresponding period, whether the emitted light passes through said hole or not.

* * * * *